US005588269A

United States Patent [19]

Wagner

[11] Patent Number: 5,588,269

[45] Date of Patent: Dec. 31, 1996

[54] PREFABRICATED CONSTRUCTION SYSTEM FOR A TIMBER HOUSE

[75] Inventor: Edmund Wagner, Wiesbaden, Germany

[73] Assignee: Zorbedo GmbH, Wiesbaden, Germany

[21] Appl. No.: 297,919

[22] Filed: Aug. 31, 1994

[30] Foreign Application Priority Data

Sep. 1, 1993 [DE] Germany ..... 43 29 413.8

[51] Int. Cl.[6] ..... E04B 2/00

[52] U.S. Cl. ..... 52/270; 52/220.2; 52/220.7; 52/284; 52/285.2; 52/286

[58] Field of Search ..... 52/270, 284, 285.2, 52/286, 220.2, 220.7, 223.7

[56] References Cited

U.S. PATENT DOCUMENTS

| | | | |
|---|---|---|---|
| 149,678 | 4/1874 | Rhodes | 52/286 X |
| 1,684,050 | 9/1928 | Adams | 52/284 X |
| 2,129,441 | 9/1938 | Otto . | |
| 2,832,101 | 4/1958 | Stark | 52/285.2 X |
| 3,500,597 | 3/1970 | McKenzie . | |
| 3,742,665 | 7/1973 | Henry et al. | 52/284 |
| 3,924,369 | 12/1975 | Guarino et al. | 52/220.7 X |
| 3,927,498 | 12/1975 | Benedetti | 52/284 X |
| 4,065,895 | 1/1978 | Shank et al. . | |
| 4,588,190 | 5/1986 | Stewart et al. | 52/223.7 X |
| 4,757,656 | 7/1988 | Powers, Jr. | 52/223.7 X |
| 4,813,193 | 3/1989 | Altizer | 52/220.2 X |
| 4,896,469 | 1/1990 | Wright | 52/220.2 |
| 5,353,560 | 10/1994 | Heydon | 52/270 X |

FOREIGN PATENT DOCUMENTS

| | | |
|---|---|---|
| 0072839 | 7/1985 | European Pat. Off. . |
| 0197958 | 12/1988 | European Pat. Off. . |
| 2569152 | 2/1986 | France . |
| 2659370 | 3/1990 | France . |
| 1219653 | 6/1966 | Germany . |
| 2639314 | 3/1978 | Germany . |
| 8309825 | 11/1983 | Germany . |
| 8803978 | 6/1988 | WIPO . |

*Primary Examiner*—Wynn E. Wood
*Attorney, Agent, or Firm*—Spencer & Frank

[57] ABSTRACT

A prefabricated, modular assembly for the building of a timber house, including a plurality of rectangular, panel elements. Each panel element has two rectangular panels each having two oppositely located first sides, and two oppositely located second sides. Each panel element is provided with two parallel, solid wood, continuous girders, each being positioned between and connected to the panels on a respective first side. The panels and the girders collectively form a box. One of the girders projects beyond the panels and the other girder is set back upon the panels by a distance corresponding to the girder projection to form a tongue and groove joint. The panels project beyond the ends of the girders at the second sides to form a continuously extending, rectangular receiving groove. The assembly also includes an orientating beam having a rectangular cross section insertable into a respective receiving groove for orientating the respective panel elements to one another. Adjacent panel elements are connected to each other using the tongue and groove joint. The inserted orientating beam abuts against each respective panel and forms a continuous free space with an end of each respective girder for the receiving of supply lines.

13 Claims, 11 Drawing Sheets

PREFABRICATED CONSTRUCTION SYSTEM FOR A TIMBER HOUSE

CROSS-REFERENCE TO RELATED APPLICATION

This application claims the priority of German Patent Application Serial No. P 43 29 413.8-25 filed Sep. 1, 1993, which is incorporated herein by reference.

BACKGROUND OF THE INVENTION

The invention relates to a prefabricated construction system for the building of a timber house with a modular construction method wherein rectangular panel elements of a box-type construction are provided as essential elements of the construction system.

Such a prefabricated construction system is described in an article entitled "Transportable Leicht-Holzhäuser" [Transportable Lightweight Timber Houses] published in the "Baumarkt Leipzig" magazine, 34. volume 1935, page 1476. There, the wall elements connected to each other via tongue and groove joints are placed on a continuous track so that they can be oriented in alignment with each other and that an overall stabilization occurs. The track consists of a lower strip with a rectangular cross section with a narrower, truncated cone-shaped, profiled strip being centrally placed on the upper side of the lower strip and being connected to the lower strip. The lower receiving region of the panel element has a receiving profile that corresponds to the profile of the truncated cone-shaped narrower strip and thus the desired orienting function is accomplished.

This known construction, however, has several drawbacks: On the one hand, a lower strip with a truncated cone-shaped receiving element on the panel element must be affixed as a separate construction element. On the other hand, the base strip must be provided with the truncated cone-shaped, narrower strip; these three strips must be made separately and be connected to the relevant members. In a addition, a longitudinal joint is created on the finished wall, i.e., between the upper edge of the base strip and the lower edge of the panel element. Such longitudinal joints are a drawback because, on the one hand, they diminish the heat insulation and, on the other, for aesthetic reasons.

Furthermore, the abutting panel elements are connected to each other by rods that are inserted into the grooves. This, too, is expensive.

A corresponding design is also provided for at the top of the wall elements and leads to the aforementioned drawbacks there, as well.

The U.S. Pat. No. 2,129,441 describes a similar prefabricated construction system wherein the panel elements can be connected to each other with a modular construction method via a tongue and groove joint. On the upper and lower side of the panels described, the solid girders are set back vis-a-vis the panels by a certain measure, which creates continuous receiving elements in longitudinal direction on the top and bottom of the panel elements. These receiving elements serve to connect the panel elements to other constructive elements of the construction system.

There, the tongue-and-groove joint is achieved by simply shifting the solid wood girders vis-a-vis the panels placed on top of the girders, just like in the present invention.

DE 83 09 825 U1 also describes a prefabricated construction system with panel elements of a box-type construction. Here, the continuous girders have an I-section made of solid wood. It is, however, very expensive to make such sections. The manufacture also produces much waste.

Another construction system, also of timber construction, is described in EP 0 072 839 B1. Here, the wall elements that are erected in alignment with each other are connected to each other with rods which are inserted into corresponding receiving elements (grooves) at the lateral edges of the panel elements abutting against each other. Thus, apart from the box-shaped panel elements, additional construction elements are needed, namely the aforementioned connecting rods.

WO 88/03978 describes another construction system wherein the panel elements are connected to each other via additional transoms inserted into slots arranged in transverse direction to the panel elements. The transoms thus violate the outer skin of the panel elements. The transoms serve as abutment for the screw joints of the abutting panel elements. Here it is also difficult to tighten the screw joint nuts because they are not openly accessible and no workable solution is offered for this problem.

EP 0 197 958 B1 describes a construction system in which the continuous girders are provided with bores that are in alignment with each other through which supply lines can be passed. Thus, for each supply line, a system of bores that are in alignment with each other must be provided, which is expensive. Even more disadvantageous is the fact that the supply lines must be threaded through the bores, as it were, which is difficult to achieve in situ. This threading must take place before the panelling is affixed to the panel elements. In these places the required heat insulation can no longer be installed.

The German published patent application 1 219 653 describes another prefabricated timber construction system wherein the panel elements abutting against one another are connected to each other via bolts whose heads are oblong-shaped. This means that the panel elements must be provided with corresponding slots so that the bolts with their oblong-shaped heads can be passed through. The bolts are then turned by 90° to prevent them from slipping out of the slots and, finally, they are tightened. It is, however, more difficult to produce such oblong-shaped slots than holes with circular cross sections which can be made by simple drilling.

SUMMARY OF THE INVENTION

The invention avoids these drawbacks. It is the object of the invention to propose a prefabricated construction system including a plurality of rectangular, panel elements. Each panel element includes two rectangular panels each having two oppositely located first sides, and two oppositely located second sides. Each panel element further includes two parallel, solid wood, continuous girders, each being positioned between and connected to the panels on a respective first side. The panels and the girders collectively form a box. One of the girders projects beyond the panels and the other girder is set back upon the panels by a distance corresponding to the girder projection to form a tongue and groove joint. The panels project beyond the ends of the girders at the second sides to form a continuously extending, rectangular receiving groove. Also provided is an orientating beam that is insertable into a respective receiving groove for orientating the respective panel elements to one another. Adjacent panel elements are connected to each other using the tongue and groove joint. The present invention is additionally characterized by simple manufacture and assembly and in which especially the supply lines, in desired type and number, can be installed in a simple manner without noticeably impairing the heat insulation system of the building which may be provided.

This object is achieved by the invention by providing an orientating beam with a rectangular cross section. The orientating beam is insertable into a respective receiving groove. The inserted orientating beam abuts against each respective panel and forms a continuous free space with an end of each respective girder for the receiving of supply lines.

Since the orienting beams have rectangular cross sections, their manufacture is very simple. Since they are inserted into the corresponding receiving elements of the panel elements (from the top and/or from below), there are no disturbing joints at the top and bottom of the panel elements, as is the case in prior art of the generic type. According to the invention, the receiving elements at the top and bottom side of the panel elements, which are present to begin with, are made larger than would normally be necessary for the orienting beams, and the additional space is used to receive the supply lines.

In the building to be erected, the panel elements can be installed in any place, as is described in more detail in the special descriptive part, e.g., as wall elements, ceiling elements and/or roof elements. If they are used as wall elements, i.e., in perpendicular arrangement, it must be ensured that the upper orienting beam leaves the aforementioned free space open for the supply lines located there, if supply lines also are to be installed at the top. For this reason, supports for the upper orienting beam are preferred, the supports being configured on the girders that are present anyhow.

The girders should be made of solid wood and, with regard to the panels abutting against the girders, it is also preferred if these are made of wood or a wood-based material. They may also be organically bound panels or panels with mineral binding. Wood panels bound with adhesives are organically bound panels. Inorganically or minerally bound panels are, for instance, plaster-bound panels but not cement-bound panels.

With regard to the connection of the construction elements of each panel element to each other and also of the panel elements with each other, it is preferred that this be achieved through adhesive bonding over the entire surface, because, together with the basic wood construction, this also meets today's timber construction requirements in a very satisfactory manner. In addition, the construction elements may be screwed or nailed together, which mainly serves the purpose of holding the parts pressed together until the adhesive has set.

The construction system according to the invention is, inter alia, characterized by the fact that, together, the continuous girders abutting against each other in the tongue-and groove joint form a strengthened beam which achieves greater stability. A package with new static properties is formed.

The orienting beams provided at the top and at the bottom serve to orient the wall elements. They extend over the entire wall to be erected, i.e., over several widths of the panel elements (wall elements). They are affixed to the floor and bonded together or inserted into the designated openings at the top which are solely formed through the configuration and arrangement of the individual construction elements (girders and panels) of the panel elements. Thus, no additional construction elements are needed; on the contrary, the girders merely must be configured shorter than the panels.

The stabilization of the panel elements with regard to one another is accomplished according to the invention by three constructive measures that complement each other, namely by the tongue-and-groove configuration of the sides of the wall elements or panel elements, by the lower orienting beam and by the upper orienting beam. In addition, the parts are bonded to each other.

The upper orienting beam or top guide has three functions, namely to close off the panel elements on the top side, to orient the parts in alignment with each other and to stabilize or brace the entire system. The same applies to the lower orienting beam, also called bottom guide.

According to the invention, entire bundles of supply lines can be installed in the corresponding free spaces in the respective desired arrangement. They may take up almost the entire cross section of the panel element, possibly on both sides or only on one side of the panel element. The entire space between the supply lines remains open for additional thermal insulation, especially bulk materials. The installation of the supply lines is already possible before the panel elements are placed (in the lower region on the bottom guide), but also after the placing of the panel elements has been completed (top region below the top guide). Additionally, the cross section is only insignificantly weakened by the free spaces mentioned.

The screw joints are characterized by the fact that their cross section becomes larger after the corresponding bolt has been turned, which thus safely prevents the bolt from slipping back. Nevertheless, only circular bores that can be made easily are required for passing the bolt, including the securing element, through the bore. Despite the fact that it is often difficult to access the screw joints, these joints can be tightened or loosened in the construction according to the invention.

BRIEF DESCRIPTION OF THE DRAWINGS

The invention is explained in greater detail below with reference to embodiments from which emerge further important characteristics. The drawings illustrate.

DESCRIPTION OF THE PREFERRED EMBODIMENTS

Figure 1:
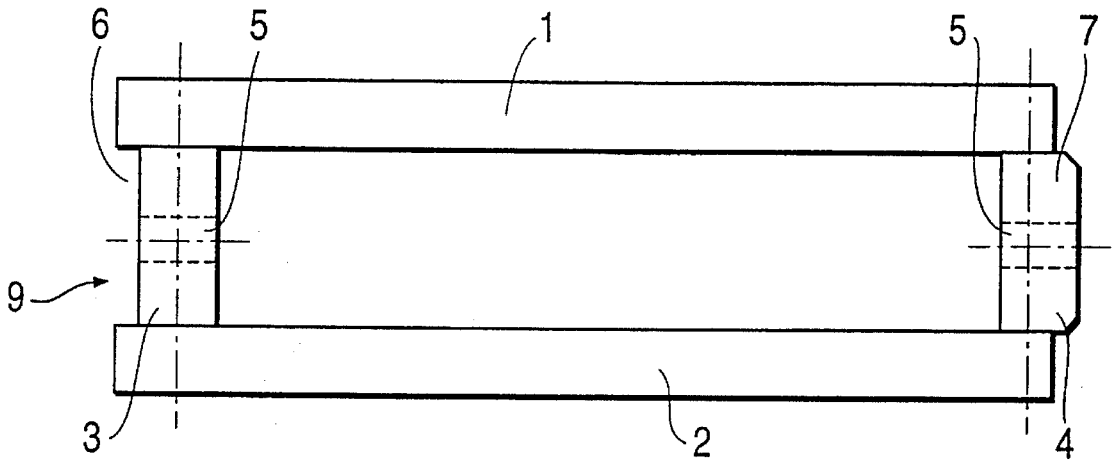
FIG. 1 a plan view of a panel element according to the invention in a first embodiment.

The timber construction element according to the invention is shown in FIG. 1 in a plan view (plan). It consists of the two space-enclosing panels 1 and 2 made of wood or a wood-based material with organic or inorganic (mineral) binding. These are connected to each other by girder 3 made of solid wood. Panels 1 and 2 are bonded and/or screwed to girders 3 and 4. Adhesive bonding has the advantage of an enhanced distribution of forces so that preference should be given to this type of full-surface connection. The screw joint may, if desired, serve the purpose of initial fixing until the glue has cured and set.

This panel element 9, consisting of panels 1 and 2 glued together and of girders 3 and 4, is the basic building block (module) of the timber construction system according to the invention.

It can be seen in FIG. 1 that the two girders 3 and 4 are arranged unevenly (non-symmetrically). This is done because the shifting of girder 3 creates a groove 6 into which the projecting region 7 (tongue) of girder 5 of an adjacent, identical panel element fits snugly. In this way a force-transmitting connection between the two panel elements is created.

Tongue 7 of the panel element can be adjusted so that it can be inserted more easily into groove 6 of the adjacent panel element.

Additionally, bores 5 can be seen in FIG. 1 which are explained further later in the text.

Figure 2:
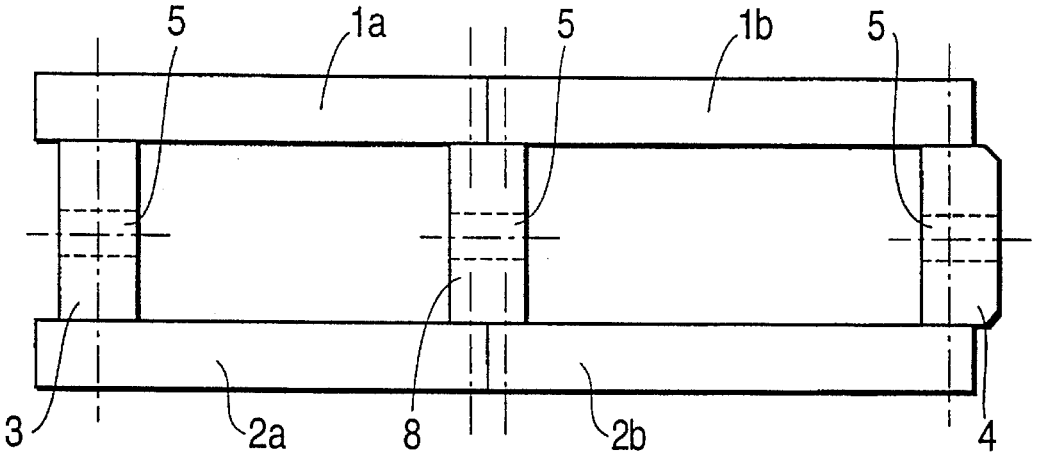
FIG. 2 a plan view of a panel element that is modified in comparison.

FIG. 2 illustrates the same schematic as FIG. 1 but with the difference that panels 1 and 2 of FIG. 1 each consist of two partial panels 1*a* and 1*b* or 2*a* and 2*b*. This division of the two panels could, for example, become necessary because of predetermined dimensions of the selected timber elements (boards). In such a case, a further girder 8 is required which is inserted in addition to the two girders 3 and 4.

Girder 8 is screwed and/or advantageously glued to the partial panels 1*a* and 1*b* and 2*a* and 2*b*, as has been described above for the panels. The same applies to further divisions.

The additional girder 8 also has a bore 5 which has the same alignment as the bores 5 of the other two girders 3 and 4.

In FIG. 1 and 2 the screw joints are merely indicated by center lines.

Figure 3:
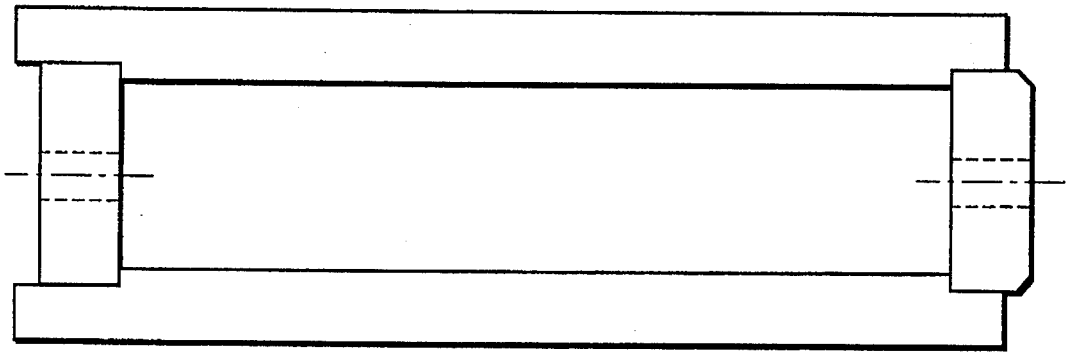
FIG. 3 a plan view of a panel element modified compared to FIG. 1.
Figure 4:
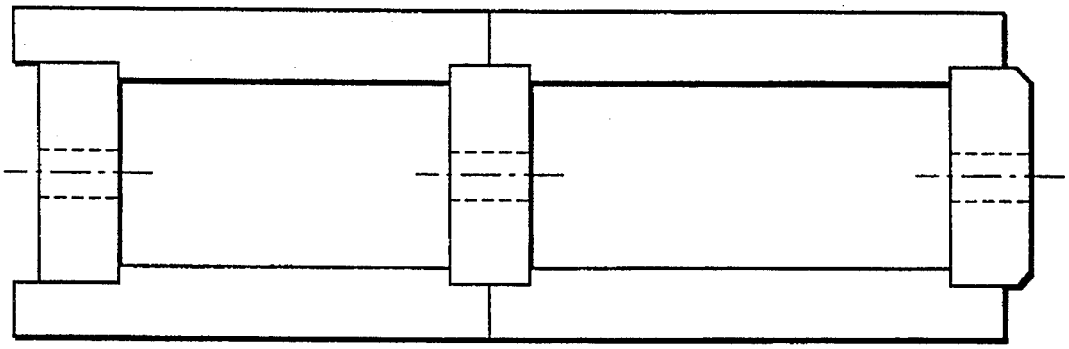
FIG. 4 a plan view of a panel element modified compared to FIG. 2.
Figure 5A:
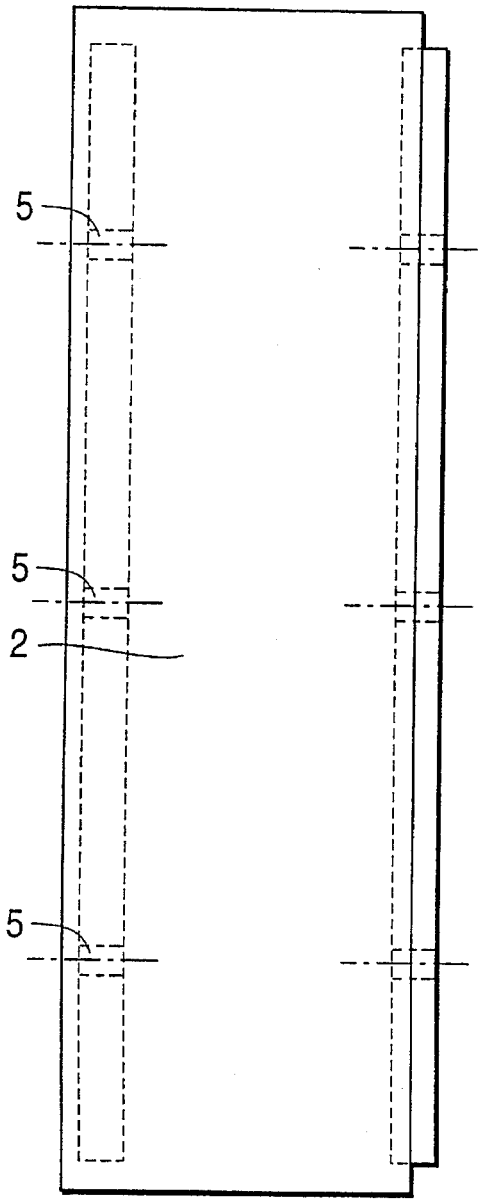
FIG. 5 in three views, a plan view according to FIG. 1, a view of the panel element of FIG. 1 and an end view of this panel element with two orienting beams shown at a distance from the panel element.
Figure 5C:
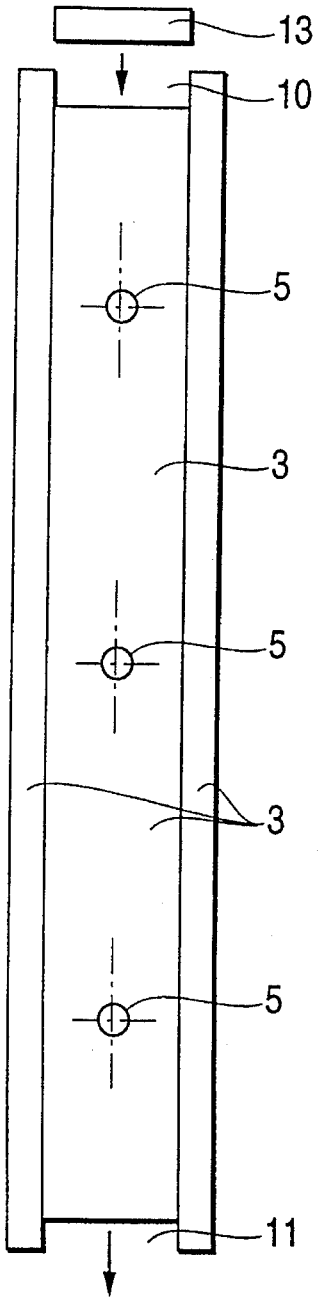
Figure 5B:
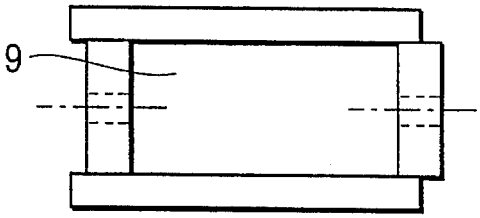
Figure 5D:
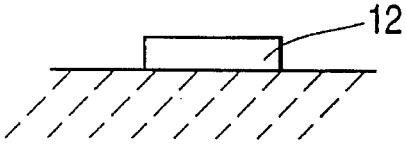

FIG. 3 and 4 show the plans of the timber panel elements according to the invention with the same functions as have already been described for FIG. 1 and 2 but with the difference that the relevant girders have already been embedded into the panels and have been bonded there. This construction method according to FIG. 3 and 4 can advantageously be selected for machine manufacture.

The bottom left of FIG. 5 shows the plan of panel element 9 according to FIG. 1 to 4.

The vertical projection in the upper left of FIG. 5 illustrates the arrangement of the girders which were described above including the setting back (groove) or projecting (tongue) of elements (see FIG. 1).

The side view on the right of FIG. 5 again shows the above-mentioned bores 5 from FIG. 1 as well as a girder 3.

The side view shows receiving elements 10, 11 on the top and bottom. These serve to take in a bottom guide (orienting beam) 12 or a top guide (orienting beam) 13 whose function will be described in the following.

Figure 6:
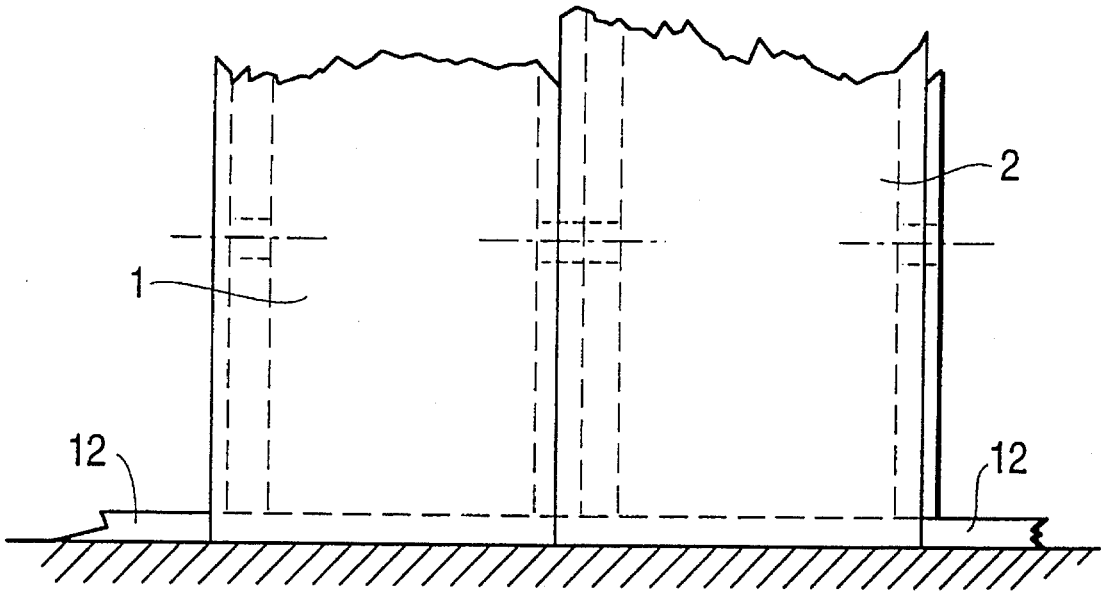
FIG. 6 a view or plan view of two panel elements that are connected to each other, here as wall elements.

FIG. 6 shows two of the panel elements 9 in plan and side view, with the elements having already been connected to each other. The important detail in FIG. 6 and 7, which goes beyond the previous figures, is the function of the bottom guide 12.

The function of the bottom guide according to the invention is the following:

It presents a problem to erect one panel element after another in proper alignment and to connect them to each other. The bottom guide preferably consists of an extended wooden section (board or similar element) which fits snugly into the receiving element 11 of FIG. 5. Before erecting the panel elements, the bottom guide is oriented precisely on the floor and aligned in accordance with the place where the wall is to be erected and the bottom guide is then fastened (screwed, nailed, preferably glued).

It is advisable to first place bottom guides over the entire floor area. Thus the ground plan is clearly recognizable.

Figure 7A:
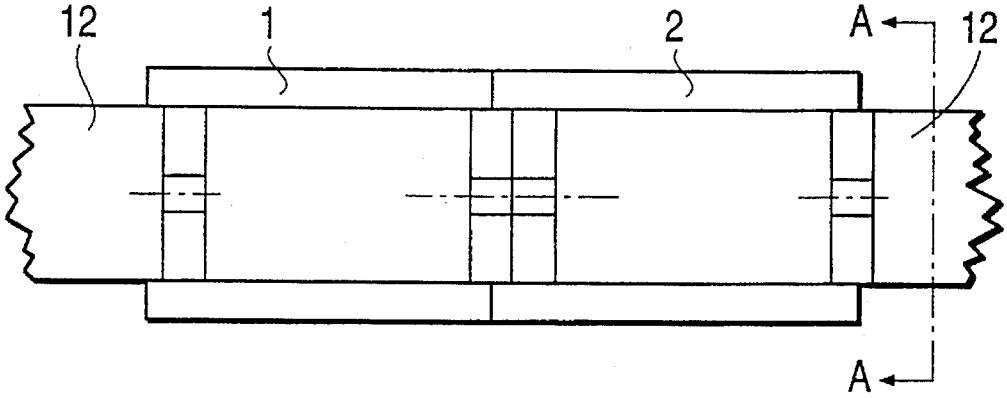
FIG. 7 a section along the line A—A of FIG. 6.
Figure 7B:
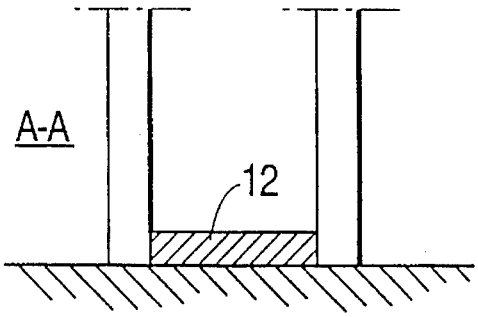

Only now are the panel elements 9 placed on top of the bottom guide piece by piece and they are then glued, as can be seen from FIG. 6 and 7. The panel elements are then in their proper place and are already in alignment.

Once the panel elements have been erected in the described manner, they are provided with the top guide 13 according to FIG. 5, which, preferably, also consists of an extended wooden section (board or similar element). This is inserted into receiving element 10 of FIG. 5 and also connected, preferably glued, to the panel elements standing in a row.

Apart from orienting the panel elements, the top guide also has the function of a cover. The ceiling or another construction element can then be placed on top.

Figure 8A:
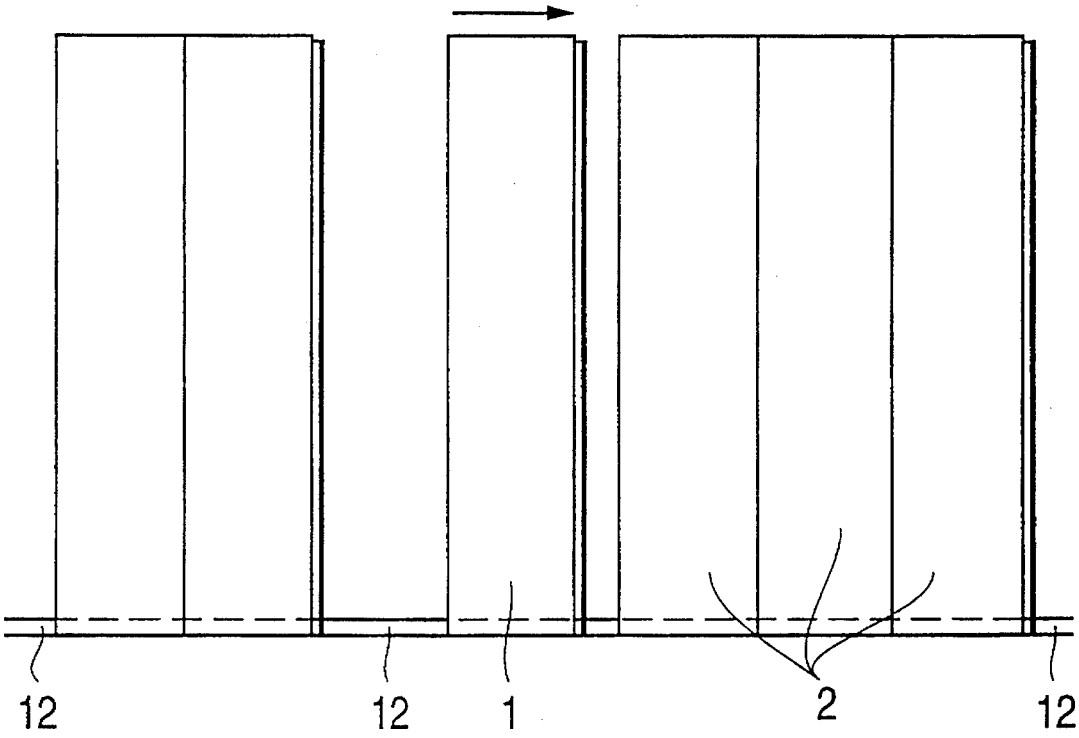
FIG. 8 a view or plan view of several wall elements during their installation.
Figure 8B:
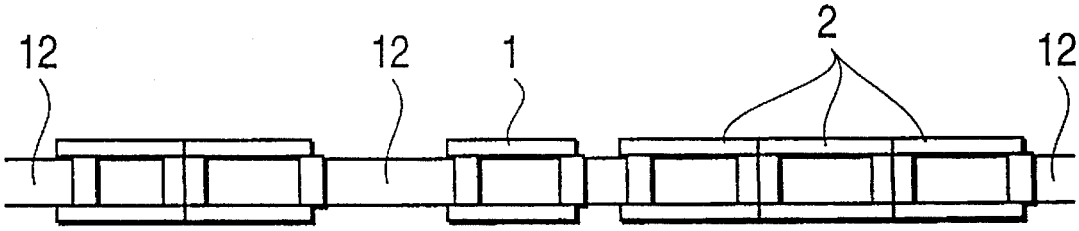

FIG. 8 further illustrates the principle of placing the individual panel elements according to the invention. The center panel element is just pushed to join the row of panel elements already standing (FIG. 8 on the right). FIG. 8 clearly shows the bottom guide 12 and its described function in vertical projection (top) and plan view (bottom).

Also clearly visible in the plan view (bottom) of FIG. 8 is the form-fitting connection among the panel elements 9 (tongue and groove), a preparatory description of which was already given in FIG. 1 and which can also be seen clearly especially in FIG. 6.

Figure 9:
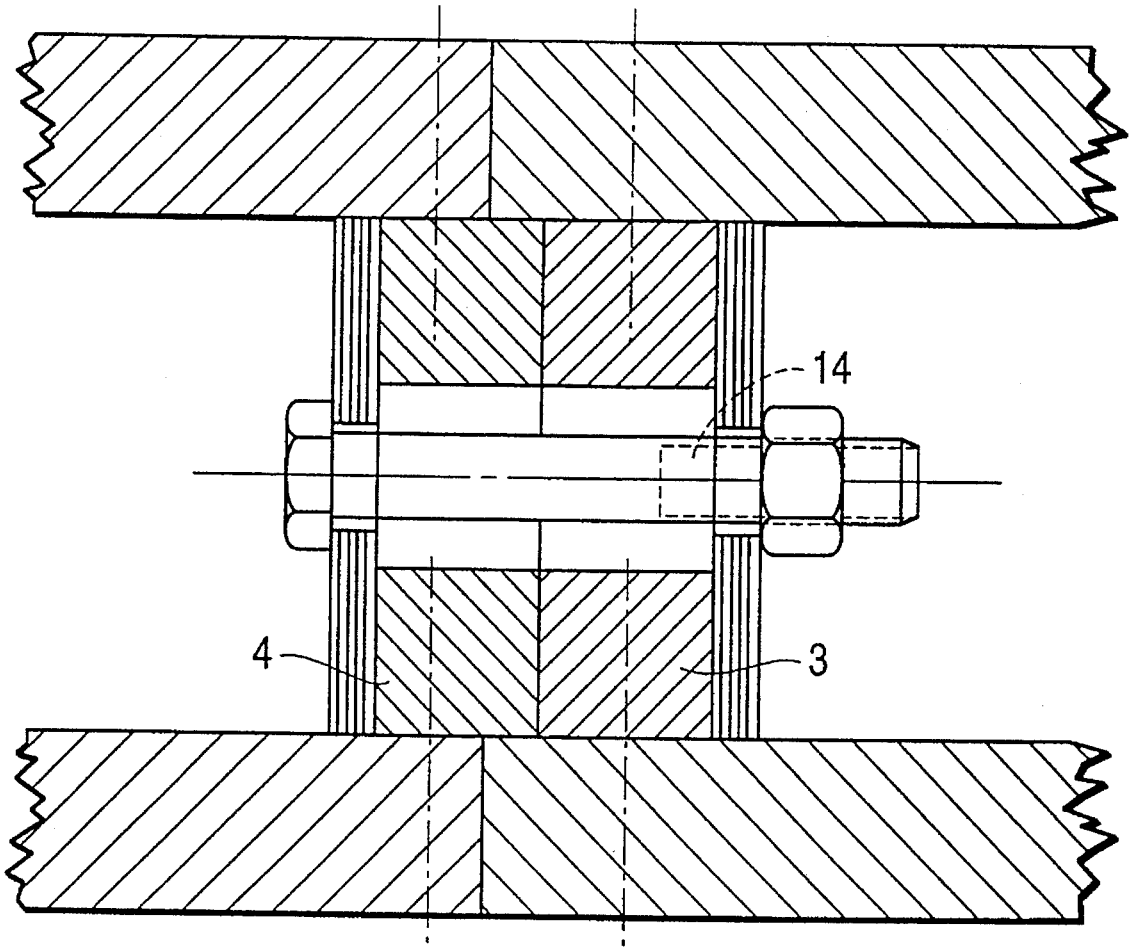
FIG. 9 an enlarged section through the ends of two panel elements abutting against each other with a screw joint of the girders of the panel elements.

In addition to the form-fitting connection of the panel elements among themselves, there is the force-transmitting connection through screw joints and gluing. FIG. 9 shows a possible screw connection. Here it also becomes clear which purpose is served by the bores 5 that must be in alignment with each other, the bores having been mentioned several times already (see specially FIG. 1 and 5). The girders 3 and 4, described in detail in FIG. 1 et seq., are connected to each other with the aid of this screw joint 14 including washer 15.

Figure 10:
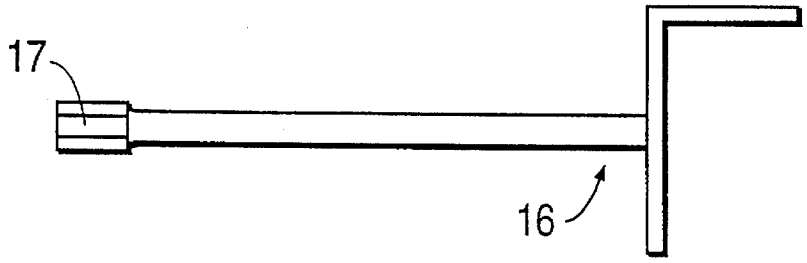
FIG. 10 a screw jack for the manipulation of the screw joint.

FIG. 10 features a screw jack 16 with which the above described screw joint can be tightened. With this screw joint it is possible to guide a hexagon wrench 17 through the bores 5 of the adjacent girders to the screw joint which is embedded deep in the panel element in order to tighten it.

Figure 11:
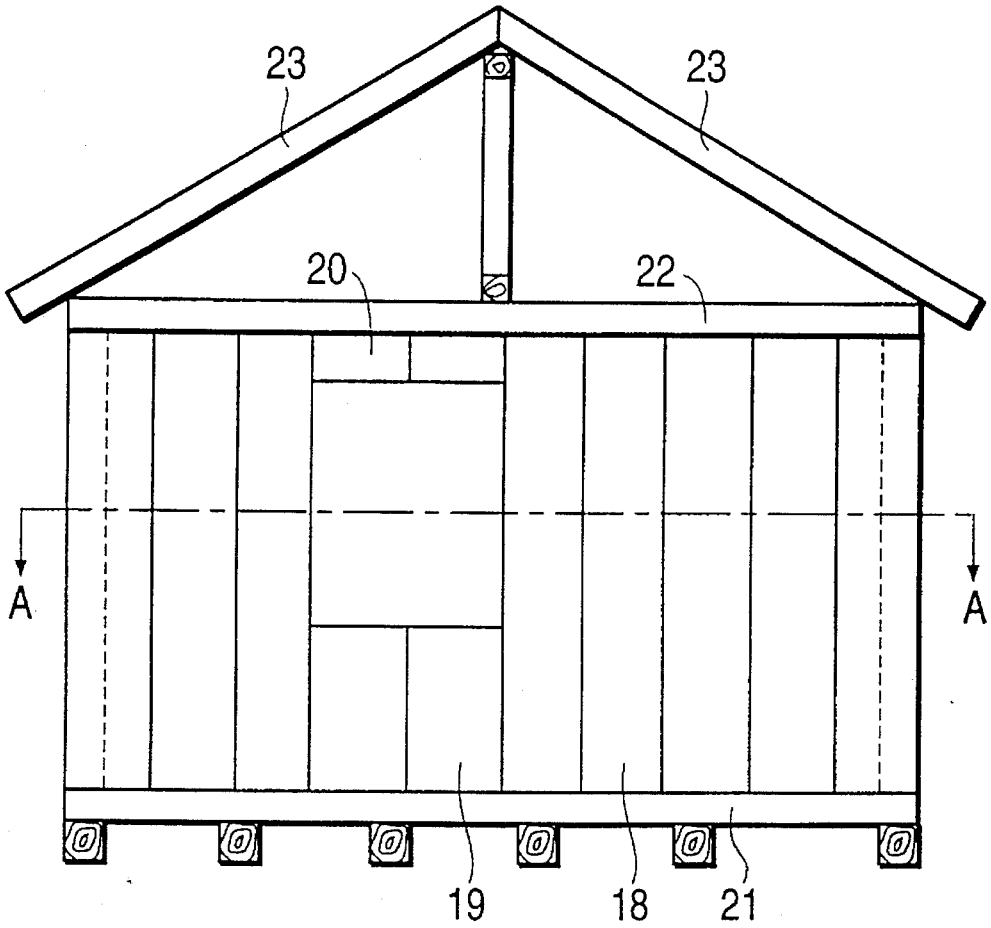
FIG. 11 a schematic view of a timber house built with the construction system according to the invention.
Figure 12:
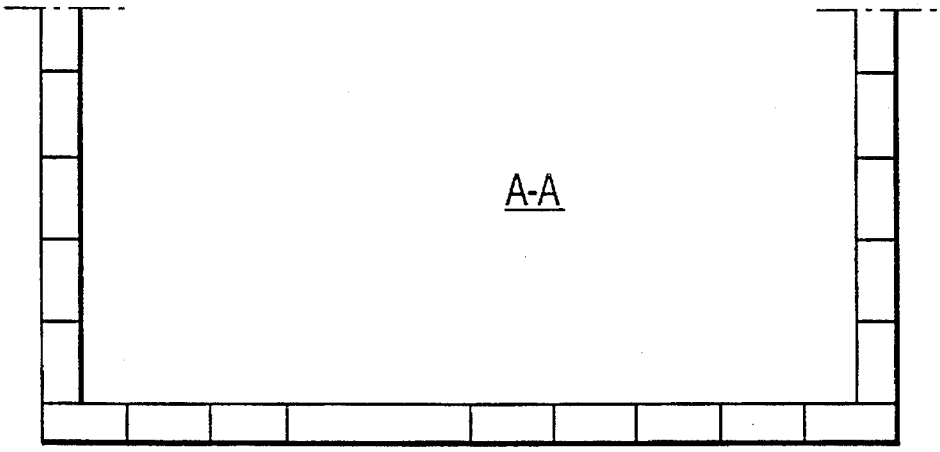
FIG. 12 a section along the line A—A of FIG. 11.

FIG. 11 and 12 show a vertical projection and plan section of a possible building constructed with the timber construction elements according to the invention.

FIG. 11 illustrates the various functions of the timber construction elements. Not only can the timber construction elements be used as a space-enclosing wall 18 having a floor-to-floor height but, if dimensioned accordingly, also as window parapet 19 or as window lintel 20. These [uses] are mentioned here only to point to a number of different application variants without claiming anything like completeness.

The uses of the timber construction elements according to the invention for a floor 21 (basement ceilings, etc.), ceilings 22 and also as roof elements 23, shown in FIG. 11, are also important. In these, only the dimensions of the timber construction elements change as well as their members (timber parts and intermediate timber parts according to FIG. 1 et seq.) and the type of stress applied.

These stresses are mainly pressure and buckling loads in the case of walls, while mostly bending and transverse forces are exerted on ceilings and roofs. In all cases, however, the timber construction element according to the invention meets all requirements, namely through the combined action of all members according to FIG. 1 et seq. in the tensile and pressure areas, and, in addition, through the form-fitting and force-transmitting connections of the timber construction elements among themselves according to the invention.

Figure 13:
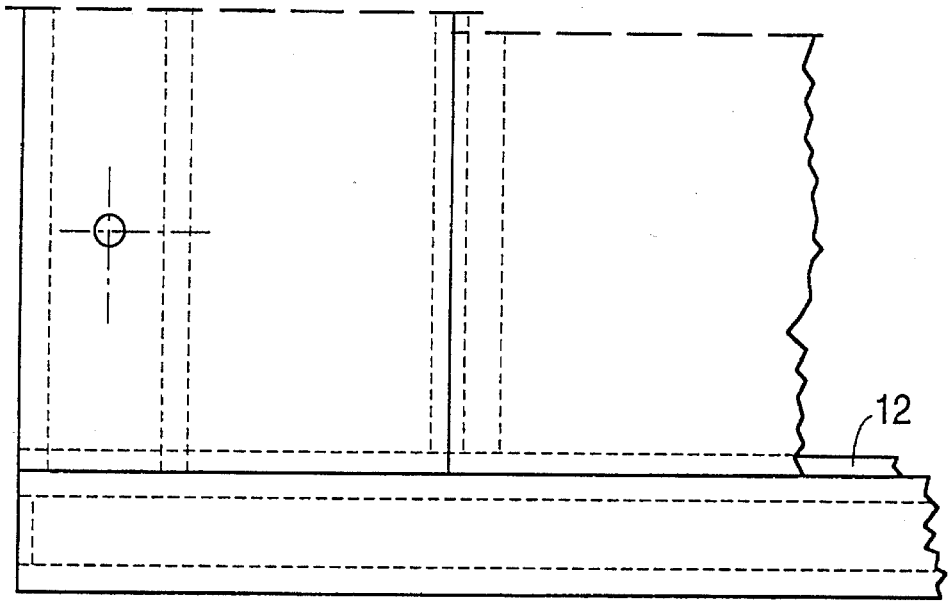
FIG. 13 a view of a corner of this building in a scale larger than in the previous drawing.
Figure 14:
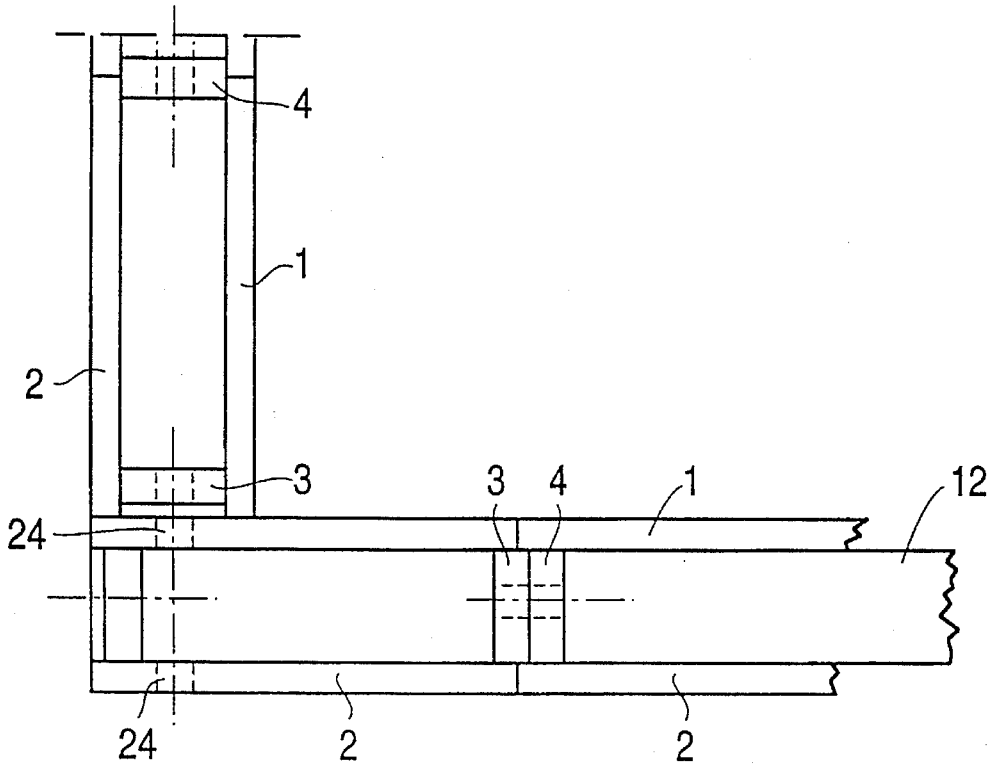
FIG. 14 a top view of FIG. 13.

FIG. 12 should shows that corner connections are also no problem. In this regard, the details of the solution are evident in FIG. 13 and 14. The necessary screw connections are indicated by the center lines in the relevant places and additional bores 24 must be provided. The corner connection is also glued.

Figure 15:
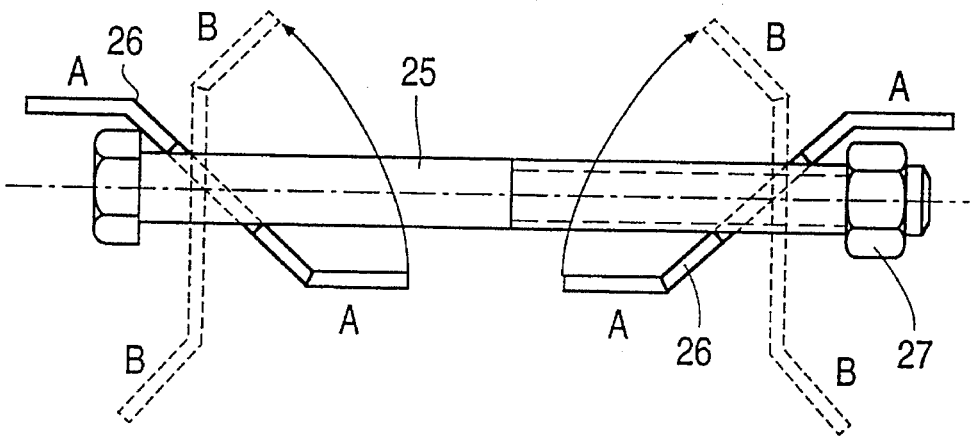
FIG. 15 a view of the essential elements of an embodiment of the screw joint.
Figure 16A:
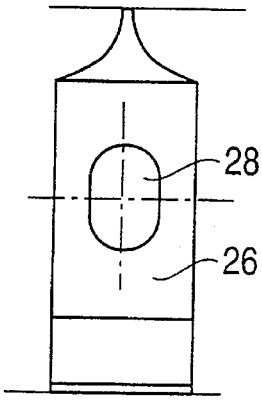
FIG. 16 three views of the fishplate used in this process.
Figure 16B:
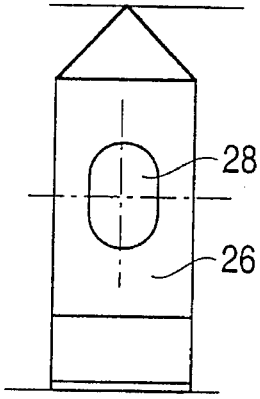
Figure 16C:
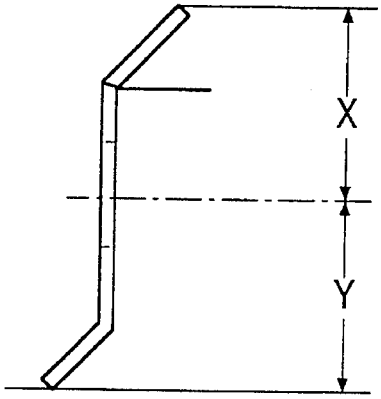
Figure 17A:
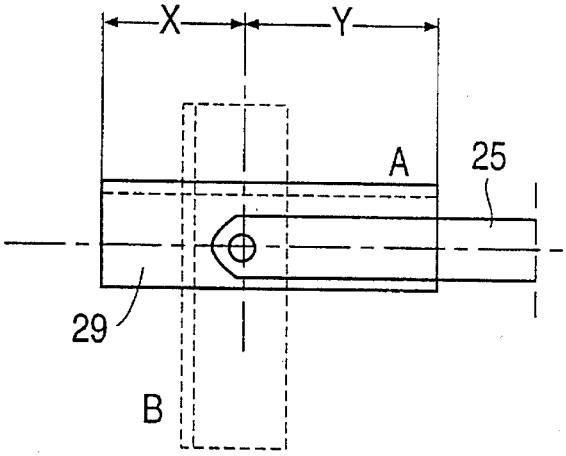
FIG. 17 a U-shaped element as a lock for the screw joint in a side view or an end view, here together with the associated bolt.
Figure 17B:
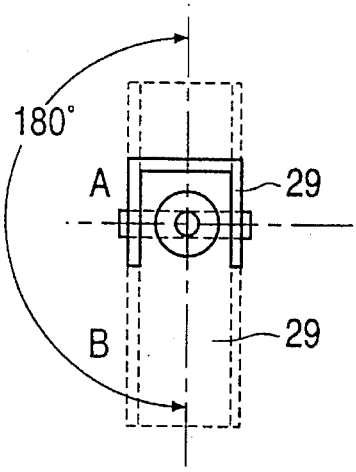

The screw joints connecting the timber construction elements with each other according to the invention are facilitated by using the embodiments shown in FIG. 15, 16 and 17. The problem of effecting a screw joint between the two adjacent intermediate timber parts, as seen in FIG. 6 and 9, in the depth of the panel elements must be solved.

For this purpose, the screw bolts 25 according to FIG. 15 provided with the fishplates (contact element) 26 according to the invention are used.

In position A (FIG. 15) of these two fishplates the screw bolt 25 is guided through the circular bore 5 of girders 3, 4, 8 together with the screw nut 27. This is possible because in position A the fishplates 26 are closely abutted against bolt 25.

Once screw bolt 25 with fishplates 26 and screw nut 27 reaches the region of the girders that are to be screwed together, with the girders disposed between the two fishplates 26, screw bolt 25 is turned by 180°. This tilts the two fishplates because of their non-symmetry and they reach position B in FIG. 15. Now the geometrical extension of the two fishplates 26 is larger than the bore through which they were guided and the screw bolt can be tightened with the screw nut 27. (To make the drawing clearer, the two girders that are to be connected have been deleted.

FIG. 16 (left or center) illustrates two embodiments of the fishplate 26 according to the invention from FIG. 15. One can see that the region X of the fishplates, owing to their non-symmetrical geometry, is lower in weight than region Y. Therefore, the fishplates will always reach a stable position in that the heavier part points downward. When the fishplates are inserted through the bores of the intermediate timber parts, the heavier part Y is first located on top so that position A in FIG. 15 is reached. Because of the rotation by 180° mentioned above, the heavier part Y falls downward so that the stable position B in FIG. 15 is reached.

The non-symmetrical geometry of the fishplates of FIG. 16 according to the invention can also be accomplished by embodiments that are different from those shown here, e.g., by shifting the elongated hole 28 in FIG. 16. The essential factor is reaching the top-heaviness after turning the screw bolt and thus also the fishplate by 180°.

During the tightening of screw bolt 25 in FIG. 15 with screw nut 27, the fishplates 26 also dig into the wood of the girders owing to the pointed embodiments of FIG. 16 according to the invention so that a further unintended tilting of the fishplates during the tightening of the screw nut in FIG. 15 is avoided. On the one hand, this pointed embodiment accomplishes that the fishplate digs into the wood, as desired, and, on the other, it achieves the required non-symmetrical geometry of the fishplates according to the invention with the above-described effects.

The illustrated construction ensures a force-transmitting connection between two timber construction elements that are to be connected to each other.

Another possibility of guiding a screw bolt through the above-mentioned bores of the intermediate timber parts is shown in FIG. 17. In position A of the screw joint according to the invention screw bolt 25 is guided through the bores of the girders together with a rotatably disposed U-shaped (contact) element 29. The bolt is then turned by 180°, as has been described with respect to FIG. 15 and 16. Thus, the longer and therefore heavier part Y of the U-shaped element becomes top-heavy and drops downward into the stable position B. Here, again, the geometry of the U-shaped element 29 according to the invention leads to the desired problem solution.

FIG. 17 shows on the right the end side of the screw joint with screw bolt 25 and the U-shaped element 29 in the two positions A and B that have already been described above. The turning by 180° is also indicated.

The geometry of the cross section of the U-shaped element is not limited to the rectangular profile illustrated. It may also be, e.g., semicircular or triangular. The important factor is the non-symmetrical and rotatable arrangement of the U-shaped element on the screw bolt according to the invention, which leads to the dropping down into the stable position B because of top-heaviness after turning by 180°. Once the U-shaped element is in the stable position B, the screw joint can be tightened.

FIG. 10 already showed the screw jack 16 which has the function of tightening screw joints as described above by fitting through the bores 5 of adjacent girders, which were already described above in detail, and of reaching the screw nuts that are to be tightened. Since it is now necessary to slightly pull back this screw nut, and thus the entire screw joint, which on its way reached its point of application, as described above, so that the fishplates according to FIG. 15 and 16 or the U-shaped element from FIG. 17 abut against the inner side of the corresponding intermediate timber part, the hexagonal region 17 of the screw jack according to FIG. 10 must be configured in a slightly conical shape according to the invention so that the screw nut 27 of the screw joint 14 or a corresponding screw nut of the screw joint according to FIG. 17 slightly tilts or wedges there and thus does not fall out of the hexagonal region 17 of FIG. 10, when the above-mentioned screw joints are pulled back again with the screw jack from FIG. 10 for a short distance. Then the screw joint can be tightened without any problem, while the screw nut 27 according to FIG. 15 slightly loosens from the hexagonal region 17 of FIG. 19.

Figure 18A:
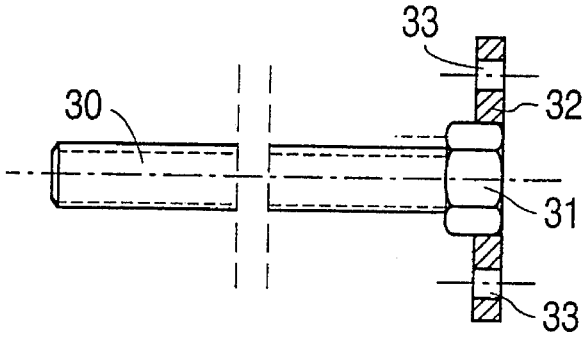
FIG. 18 a side view or end view of a further embodiment of a screw joint according to the invention.
Figure 18B:
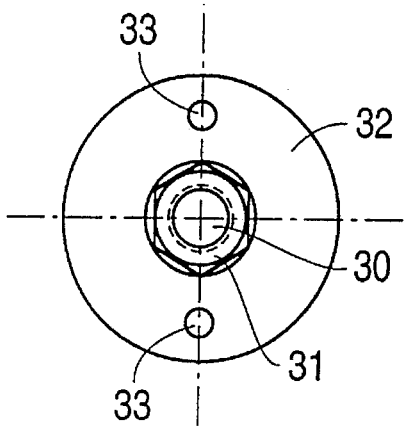

A further possibility for a force-transmitting connection of two adjacent panel elements is shown in FIG. 18. This concerns a screw bolt 30 bridging the distance between the girders on the inside of the panel element, the screw bolt having a screw nut 31 on one side around which a round steel disk 32 is disposed. All three parts are welded together. The steel disk also is provided with two bores 33 opposite of each other.

Since this also represents only a schematic diagram, the welding marks, for example, have been deleted for reasons of clarity.

Figure 19:
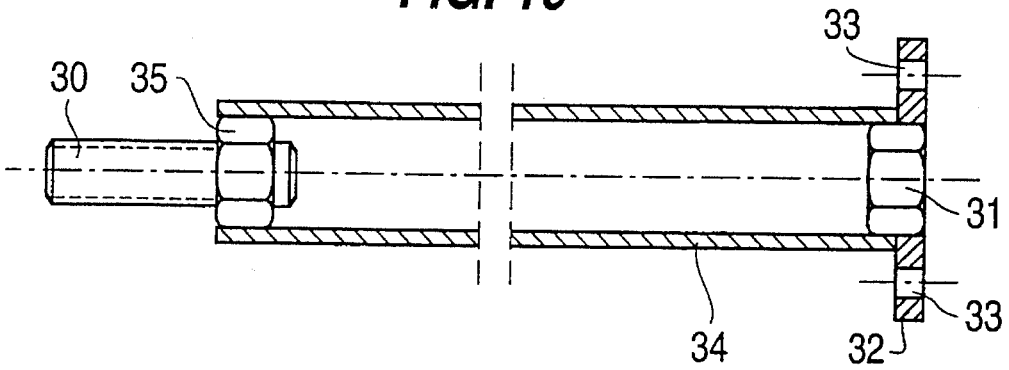
FIG. 19 a view of a screw joint that is modified in comparison to the previous drawing.

A further variant is shown in FIG. 19. There, the screw bolt 30 of FIG. 18 does not extend over the entire length, on the contrary, it is essentially replaced by a pipe 34. The shortened screw bolt 30 is screwed to a screw nut 35 which, in turn, is disposed in the pipe 34. The screw nut 31 and the round steel disk 32 with the two bores 33 are also disposed on one side. All of these parts are also connected to each other through welding.

Figure 20:
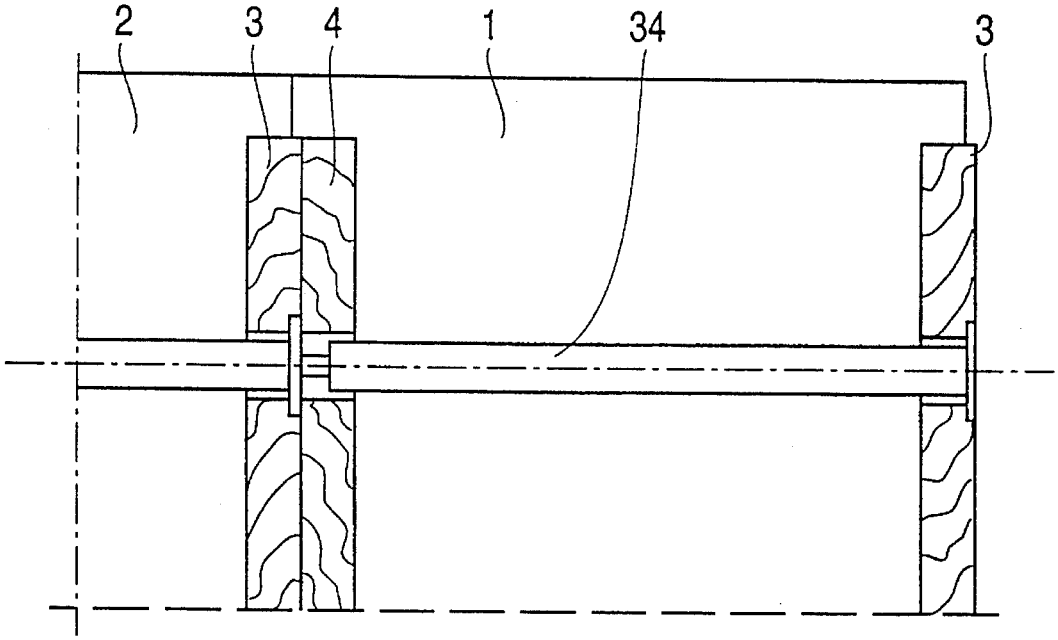
FIG. 20 the use of the screw joint according to FIG. 19 to connect two panel elements to each other.

FIG. 20 shows the mode of action of the screw joints according to the invention of FIG. 18 and particularly of FIG. 19. Two panel elements 9 are (partially) visible in sectional view. The bores 5 in girders 3 and 4 known from FIG. 4 et seq. are clearly recognizable. The distance between these girders is bridged by the screw joint which was already described in FIG. 19. At the same time, the screw joint extends with its screw bolt 30 into the thread of screw nut 31 of the adjacent screw joint. This occurred by previously passing the screw joint through bore 5 of girder 3 and by screwing it to the screw nut 31 of the adjacent screw joint. The screw joint can be tightened with a known wrench that fits into both bores 33 in the steel disk 32 of FIG. 18. Of course, the bore of girder 3 in FIG. 20 must first have been made slightly larger so that the steel disk 32 fits flush with its surface into the bore. The same procedure occurred previous to the one described above within the timber construction element 9, etc.

With the aid of the screw joint according to the invention it is accomplished that not only two adjacent girders are connected to each other in a force-transmitting manner but that also the entire panel element is pushed or pressed against the adjacent panel element previously put in place. Thus, a steel connection extends over the entire construction element (wall or floor or ceiling or roof or the like), approximately comparable to a bracing in concrete or a ring anchorage with the resulting static advantages.

This solution also makes the construction of the building particularly earthquake-proof.

Figure 21:
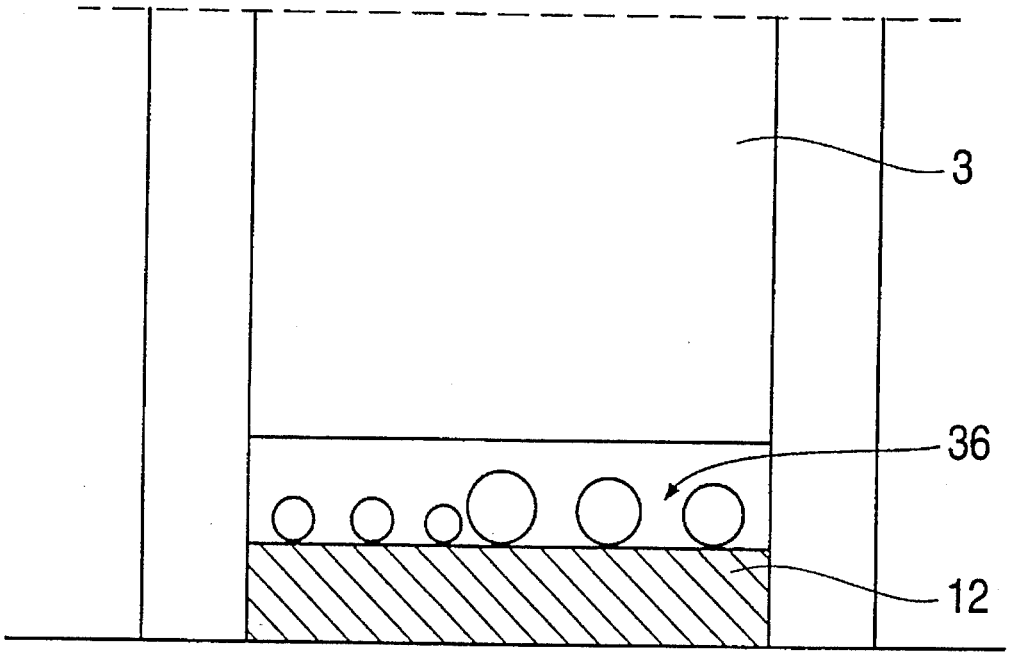
FIG. 21 an end view of the lower part of a panel element (wall element) with additional supply lines.

Finally, a further, additional solution for the installation of supply lines etc. within the wall, ceiling, etc. must be mentioned. Based on FIG. 21 according to the invention the chase known from FIG. 5 is enlarged by space 36 in the region of the relevant girder so that supply lines 37 and the like can be guided through. These supply lines can even be fastened to the bottom guide 12 before the panel element is placed.

Figure 22:
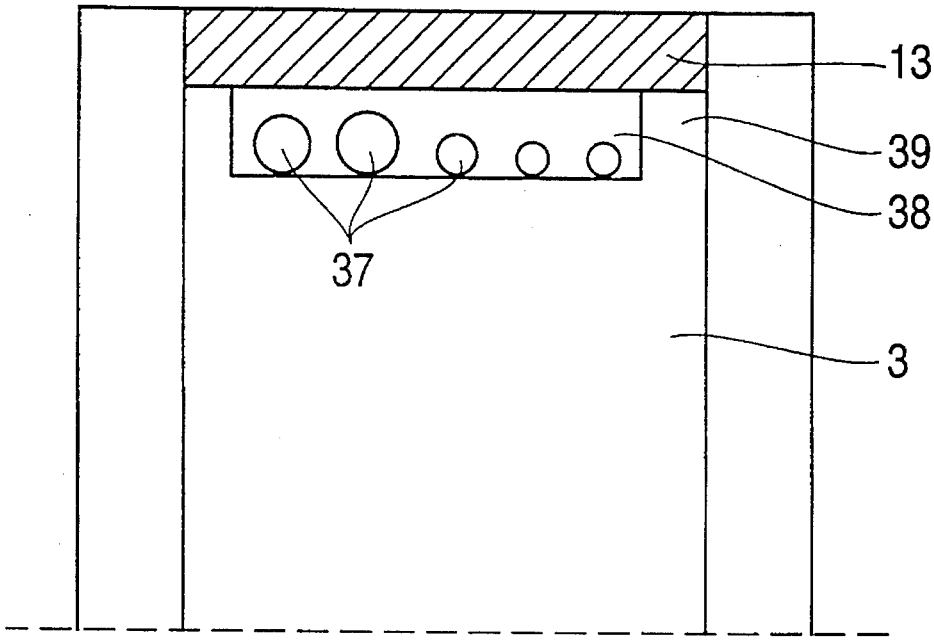
FIG. 22 an end view according to FIG. 21 illustrating the upper part of the wall element together with the supply lines installed there.

FIG. 22 shows that also in the region of the top guide 13 a space 38 can be left open in the region of the girder so that supply lines 37 can be passed through before the top guide 13 is placed on top. Here, the top guide rests on supports 39 of the corresponding girders.

In summary it must be said that the prefabricated timber construction system, which essentially is based on the timber panel element also described above and whose methods of connection deviate from timber construction methods known so far, represents a totally new timber construction method. The previously known principle of the half-timbered house and the vertical truss construction are based on a skeleton construction method. The proposed prefabricated timber construction system is based on the static principle of the box cross section as opposed to the load-bearing full cross section which can only bear much smaller loads than the box cross section.

Therefore, it is possible to carry greater loads given the same timber consumption, or, vice versa, to save timber for identical design loads. This relates to all construction members mentioned, such as walls, floors, ceilings, roofs and the like. An essential advantage is accomplished here in that individual parts of the timber construction element are glued together and in that also the timber construction elements are not only force-transmittingly screwed together but that they are also glued together in order to achieve a full-surface load transmission within the construction element based on the form-fitting connection. In this manner a rigid, structural supporting system is created which is space-enclosing at the same time and which, in addition, can be calculated and dimensioned as a disk. All cross sections are utilized for load bearing, additional space-enclosing planking that does not carry loads is not present.

In addition, the hollow spaces inside the timber construction elements are excellent receiving elements for heat and sound insulation materials. From the point of view of building physics, an excellent heat and sound insulation cross section of the wall, ceiling or roof design is created.

It will be understood that the above description of the present invention is susceptible to various modifications, changes and adaptations, and the same are intended to be comprehended within the meaning and range of equivalents of the appended claims.

What is claimed is:

1. A prefabricated construction assembly, comprising:

a plurality of box-shaped rectangular panel elements, each panel element having:

at least first and second solid, continuous wood girders separated from one another by a distance and being parallel to one another to form two opposite first sides of the respective panel element, and at least first and second panels connected to said girders and sandwiching said girders therebetween to form two opposite second sides of the respective panel element, said girders and said panels of the respective panel element collectively forming four sides of a box, wherein two adjacent panel elements are connected together with a tongue-and-groove joint, said tongue-and-groove joint being formed by projecting said first girder from between said panels along one of the first sides, and setting back the second girder within said panels by a corresponding measure along the other of the first sides, and wherein said panels project beyond the ends of said girders at two oppositely located third sides of said panel element to define an upper and a lower end of the respective panel element and form continuous receiving elements extending in a direction from one of the first sides to the other of the first sides, and a plurality of continuous orienting beams insertable into the respective receiving elements to be parallel thereto for orientating said panel elements in relation to each other at the third sides, said panel elements being placed next to each other and connected to each other by the tongue-and-groove joint, said orienting beams having rectangular cross sections and dimensions which are such that when said orienting beams are inserted into the respective receiving elements, the orienting beams abut against the inner sides of said panels, and form at each of the upper and lower ends at least one continuous free space between said orienting beams and the respective ends of said girders to receive supply lines, and at least at the upper end of said panel elements, the respective ends of said first and second girders form a support for said orienting beam designated for the respective receiving element.

2. Prefabricated construction system according to claim 1, wherein said first girder of one of the adjacent panel elements abuts against said second girder of the other of the adjacent panel elements, said girders abutting against each other being glued together over their entire abutting surfaces.

3. Prefabricated construction system according to claim 2, further comprising tension bars that additionally connect said girders abutting against each other to each other.

4. Prefabricated construction system according to claim 3, wherein said tension bars comprise bar elements that are screwed together.

5. Prefabricated construction system according to claim 4, wherein said bar elements have one end, and a contact surface at the one end.

6. Prefabricated construction system according to claim 3, wherein said tension bars comprise bolts having one end, and wherein said girders abutting against each other have bores with circular profiles in alignment with each other, the one end of the bolt having a contact element affixed thereto, said contact element being positionable into an insertion position in which said contact element abuts against said bolt so that said contact element together with said bolt can be pushed through the aligned bores, said contact element additionally being positionable into a contact position in which said contact element abuts against a corresponding surface of said girder.

7. Prefabricated construction system according to claim 6, wherein said contact element is fastened to said bolt so as to tilt around an axis, said contact element being non-symmetrical relative to the axis such that said contact element, by its weight, is swung from the insertion position into the contact position when said bolt is turned by approximately 180° around its longitudinal axis.

8. Prefabricated construction system according to claim 6, wherein said contact element includes at least one point for digging into said girder when said contact element is in the contact position.

9. Prefabricated construction system according to claim 6, wherein said contact element has one of a U-shaped cross-sectional profile formed by sidewalls, said contact element being pivotable about a swivel axis extending through the sidewalls of the U-shaped profile and, in a side view, approximately a Z-shaped profile with an elongated hole for attachment to said bolt.

10. A prefabricated, modular assembly for the building of a timber house, comprising:

(A) a plurality of rectangular, panel elements, including:

(1) two rectangular panels each having two oppositely located first sides, and two oppositely located respective upper and lower sides; and (2) two parallel, solid wood, continuous girders, each being positioned between and connected to said panels on a respective first side, said panels and said girders collectively forming a box, one of said girders projecting beyond the panels and the other girder being set back upon the panels by a distance corresponding to the girder projection to form a tongue and groove joint, the panels projecting beyond an end of each girder at the upper and lower sides to form a respective upper and lower continuously extending, rectangular receiving groove; and (B) an orientating beam having a rectangular cross section and being insertable into a respective receiving groove for orientating the respective panel elements to one another, whereby adjacent panel elements are connected to each other using said tongue and groove joint, and the inserted orientating beam abuts against each respective panel and forms a continuous free space at at least the upper side with the end of each respective girder for the receiving of supply lines, the ends of said respective girders at at least the upper side forming a support for said orienting beam designated for the upper receiving groove.

11. A prefabricated, modular construction assembly, comprising:

a plurality of box-shaped, panel elements placed next to each other and connected to each other using a tongue and groove joint, each panel element being defined by a front and back rectangular face, upper and lower parallel sides, and two additional, oppositely located sides arranged perpendicularly to the upper and lower sides, each panel element comprising;

at least two rectangular, spaced apart panels, each forming a respective face of said panel element; and at least two solid, parallel, continuous wood girders, each being connected to an inside surface of the panels along a respective additional side of said panel element, one of said girders projecting from between said panels along one of the additional sides, and the other of said girders being set back within said panels along the other additional side by a corresponding amount to form the tongue and groove joint, each of said girders having a lower, planar end face located in a region of the lower side and an upper, U-shaped end located in a region of the upper side; said panels projecting beyond both ends of said girders to form continuous upper and lower receiving grooves extending in a longitudinal direction along the respective upper and lower sides; and continuous orienting beams having rectangular cross-sections, and being insertable into the respective receiving grooves to orient said panel elements relative to each other along the additional sides, said beams being dimensioned to abut against the inner sides of said respective panels, and forming a continuous free space with the respective ends of said girders to receive supply lines, wherein the legs of the U-shaped end of the girders at the upper side form a support for said orienting beam designated for the upper receiving groove.

12. A timber house comprising:

a plurality of prefabricated, box-shaped, panel elements placed next to each other and connected to each other, each panel element being defined by a front and back rectangular face, upper and lower parallel sides, and two additional, oppositely located sides arranged perpendicularly to the upper and lower sides, each panel element comprising;

at least two rectangular, spaced apart panels, each forming a respective face of said panel element; and at least two solid, parallel, continuous wood girders, each being connected to an inside surface of the panels along a respective additional side of said panel element, each of said girders having a lower, planar end face located in a region of the lower side and an upper, U-shaped end located in a region of the upper side; said panels projecting beyond both ends of said girders to form continuous upper and lower receiving grooves extending in a longitudinal direction along the respective upper and lower sides; and continuous orienting beams having rectangular cross-sections, and being insertable into the respective receiving grooves to orient said panel elements relative to each other along the additional sides, said beams being dimensioned to abut against the inner sides of said respective panels, and forming a continuous free space with the respective ends of said girders to receive supply lines, wherein the legs of the U-shaped end of the girders at the upper side form a support for said orienting beam designated for the upper receiving groove.

13. The timber house defined in claim 12, wherein one of said girders projects from between said panels along one of the additional sides, and the other of said girders being set back within said panels along the other additional side by a corresponding amount to form a tongue-and groove joint to connect adjacent panel elements to each other.

* * * * *